United States Patent [19]

Jacob et al.

[11] Patent Number: 5,044,786

[45] Date of Patent: Sep. 3, 1991

[54] BEARING ARRANGEMENT FOR A ROTARY DRUM

[75] Inventors: Werner Jacob, Frankfurt; Martin Schepp, Schweinfurt, both of Fed. Rep. of Germany

[73] Assignee: SKF GmbH, Schweinfurt, Fed. Rep. of Germany

[21] Appl. No.: 620,155

[22] Filed: Nov. 30, 1990

[30] Foreign Application Priority Data

Dec. 7, 1989 [DE] Fed. Rep. of Germany ..... 3940446

[51] Int. Cl.[5] ..... F16C 13/06; F26B 11/02; D06F 58/06

[52] U.S. Cl. ..... 384/549; 34/108; 248/130

[58] Field of Search ..... 384/549, 558; 34/108, 34/121; 248/130

[56] References Cited

U.S. PATENT DOCUMENTS

| | | | |
|---|---|---|---|
| 2,269,700 | 1/1942 | Treshow | 248/130 |
| 2,399,189 | 4/1946 | Johnson | 384/549 |
| 3,836,103 | 9/1974 | Retali et al. | 384/549 X |
| 4,160,569 | 7/1979 | Reid | 248/130 X |
| 4,416,492 | 11/1983 | Singletary | 384/549 X |
| 4,696,116 | 9/1987 | Livingston | 384/549 X |

FOREIGN PATENT DOCUMENTS 1108718 6/1961 Fed. Rep. of Germany .

*Primary Examiner*—Thomas R. Hannon
*Attorney, Agent, or Firm*—Rosen, Dainow & Jacobs

[57] ABSTRACT

In a bearing arrangement for a rotary drum, the ends of two cradles are attached to load-carrying rollers which rotate freely over a surface area of a race of the rotary drum. The cradles run in self-aligning bearings in a load-bearing structure via intermediate cradles. Each load-carrying roller runs in bearings at the end of its respective cradle, in a manner which avoids slanting and which is free of axial clearance. Each cradle runs in rocker bearing located between its two load-carrying rollers, without bearing clearance at the end of an intermediate cradle. One of the intermediate cradles runs in a journal bearing with an axial clearance equal to or larger than the axial dislocation of the load-carrying rollers in the load bearing structure when the rotary drum is in operation.

10 Claims, 3 Drawing Sheets

BEARING ARRANGEMENT FOR A ROTARY DRUM

FIELD OF THE INVENTION

This invention relates to a bearing arrangement for supporting a rotary drum.

BACKGROUND OF THE INVENTION

A bearing arrangement for a rotary drum of the above type is disclosed, for example, in (DE-AS 1 108 718). Such a known arrangement includes a large number of load-carrying rollers around the circumference of the race for carrying the load, such that the load on the circumference of the race is distributed over many load-carrying rollers and that, accordingly, the rotary drum is supported evenly at its circumference. Together, the load-carrying rollers of this known bearing extend, with their pivot and self-aligning bearings, side-by-side in a common radial plane.

During the operation of a rotary drum of a large cylindrical rotary kiln, small changes in the position of the race occur which may vary in size along the circumference of the race, due to the deformation and bending of the rotary drum and the race attached thereto, and due to the thermal expansion of the rotary drum. Such changes in the position of the race are to be feared, above all when the race is made of a combination of various ring segments. In the latter case, part of the load-carrying rollers will be subjected to damaging side and edge loads which may try to push the load-carrying rollers of the rotary drum bearing out of their radially plane, either jointly or individually. These side and edge loads may cause relatively severe contact wear on the rolling surfaces of the load-carrying rollers, and on the surface areas of the race. In addition, these parasitic loads may place a considerable load—even an excessive load—on the accompanying pivot and self-aligning bearings.

SUMMARY OF THE INVENTION

It is therefore an object of the invention to provide a rotary drum bearing arrangement of the type described above, wherein the bearing, notwithstanding a large number of load-carrying rollers around the race, is able to function with relatively little contact wear between the race and the load-carrying rollers, and wherein the structure avoids the danger of overloading the bearings of the load-carrying rollers, cradles and intermediate cradles.

The bearing arrangement according to the invention allows the individual cradles to assume a slanted position in accordance with the deformation and dislocation of the race of the rotary drum and, in addition, it allows them to align along the circumference of the race. Furthermore, the cradles of the drum bearing are capable of moving axially within the axial clearance range of the bearing of the intermediate cradle which is self-aligning in the load bearing structure. As a result, any danger of damaging side and edge loads affecting the load-carrying rollers due to the deformation of the race during operation, or due to changes in its position, are eliminated.

Accordingly, the rolling contact between the load-carrying rollers and the surface areas of the race will result in little contact wear. The pivot bearing of the load-carrying rollers and the self-aligning bearings of the cradles and intermediate cradles are exposed to relatively small displacement forces, so that these bearings will not be overloaded, even when the rotary drum of a revolving tubular kiln is subjected to a heavy workload.

Due to the relatively small load affecting the individual load-carrying rollers, the diameter of the load-carrying rollers of the drum bearing arrangement may be small, so that the bearing arrangement can be mounted in an advantageously small space underneath the rotary drum.

The arrangement of the invention prevents the axially operating components of the contact forces of the load-carrying rollers from imparting a greater tilting moment to the accompanying cradles via the rocker bearing. As a result, damaging edge loads at the contact points of the load-carrying rollers are avoided, thereby preventing a major source of wear and tear.

The invention also prevents the axial displacement forces operating in the direction of the rotational axis of the load-carrying rollers on the accompanying cradles, from trying to tilt the accompanying intermediate cradles over an axis running through the rotational axis of the two load-carrying rollers.

The invention makes it possible, in an intermediate cradle with accompanying load-carrying rollers, for the axial forces of the journal bearing and the axial forces of the respective rocker bearing, to operate in conjunction with the axial forces of the accompanying load-carrying rollers, side-by-side, within a common longitudinal plane.

Accordingly, the bearing of the intermediate cradle will, basically, be subjected only to radial carrying forces and axial guiding forces from the load-carrying rollers, but not to parasitic forces from tilting moments at the intermediate cradle.

The respective intermediate cradle may be guided by the guiding elements in at least one of the two axial directions at the race, and held in the center.

In a further embodiment of the invention, a particularly friction-free axial guidance of the intermediate cradles with their load-carrying rollers is achieved along at least one of the two lateral surfaces of the race.

In a further feature of the invention, the pressure forces of the two guiding rollers operate at a relatively short distance from the axis of the journal bearing of the respective intermediate cradle, so that only limited tilting forces from the pressures forces are exerted on the journal bearing of the intermediate cradle.

In accordance with a still further feature of the invention, the journal bearing for the bearing arrangement of the intermediate cradle inside the load bearing structure, is adapted to be manufactured in a particularly economical manner.

In another feature of the invention, axial forces operating in the direction of the rotational axis of the rotary drum are transferred from the load-carrying rollers or the guiding rollers to the load bearing structure by way of the intermediate cradle.

BRIEF DESCRIPTION OF THE DRAWING

In order that the invention may be more clearly understood, it will now be disclosed in greater detail with reference to the accompanying drawing, wherein.

DETAILED DISCLOSURE OF THE INVENTION

Figure 1:
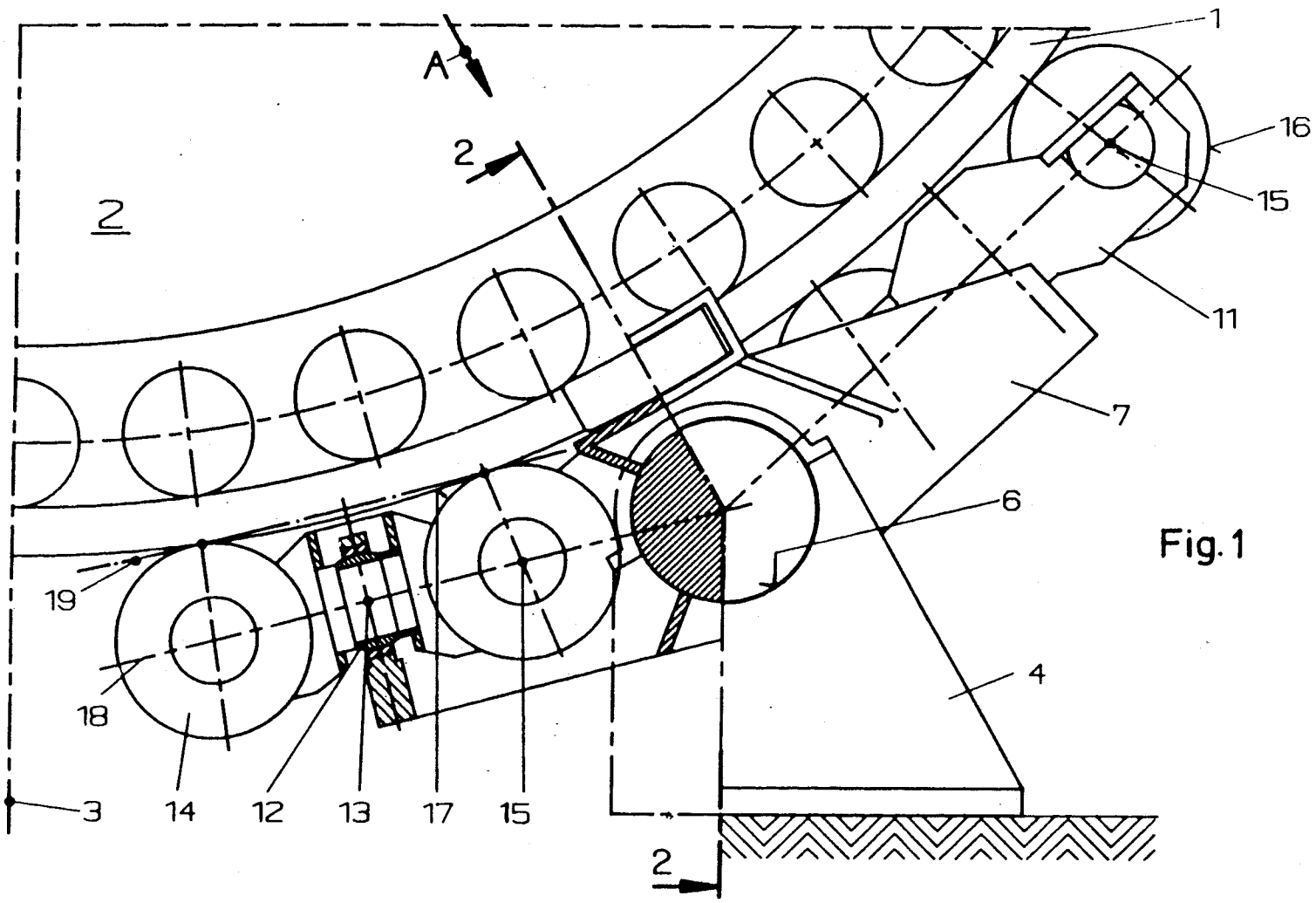
FIG. 1 is a lateral view, partially in section, of one half of a bearing arrangement for a rotary drum, in accordance with the invention.
Figure 2:
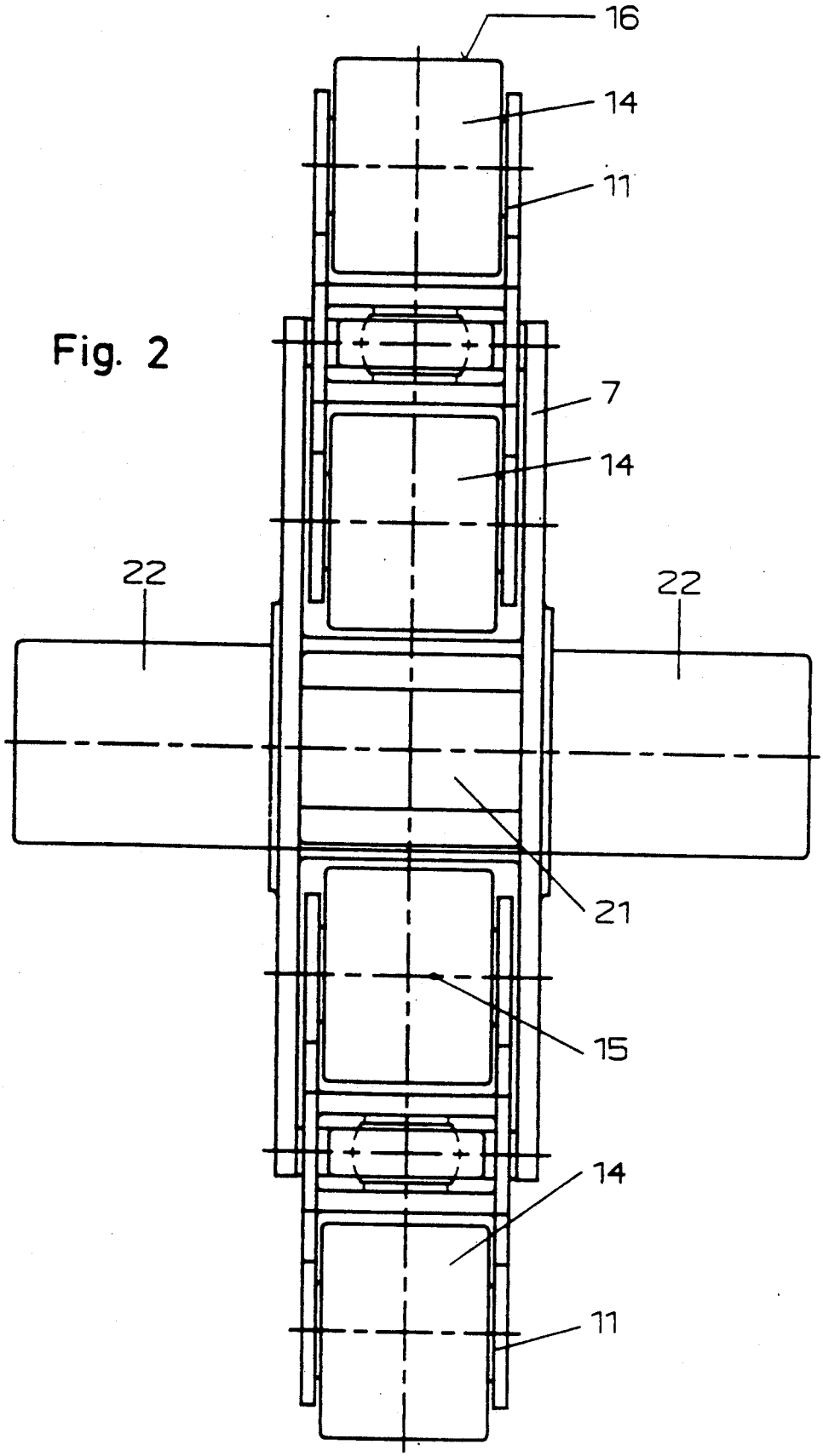
FIG. 2 is a top view in the direction of arrow A of the intermediate cradle shown in FIG. 1, outside the load bearing structure and without guiding rollers.

FIGS. 1 and 2 show one of the two halves of a bearing arrangement for the rotary drum of a revolving tubular kiln. The two halves have a common race 1 which is affixed to the rotary drum 2. The two halves of the bearing arrangement extend on opposite sides of a vertical plane 3 which passes through the axial rotational journal of the rotary drum 2. Each half of the arrangement has an intermediate cradle 7 pivoted in a self-aligning bearing in a load bearing structure 4 around an axial journal 5 of a journal bearing. The downward directed load of the heavy rotary drum 2 is transferred from the race 1 via the journal bearing 6 to the load bearing structure 4.

Figure 3:
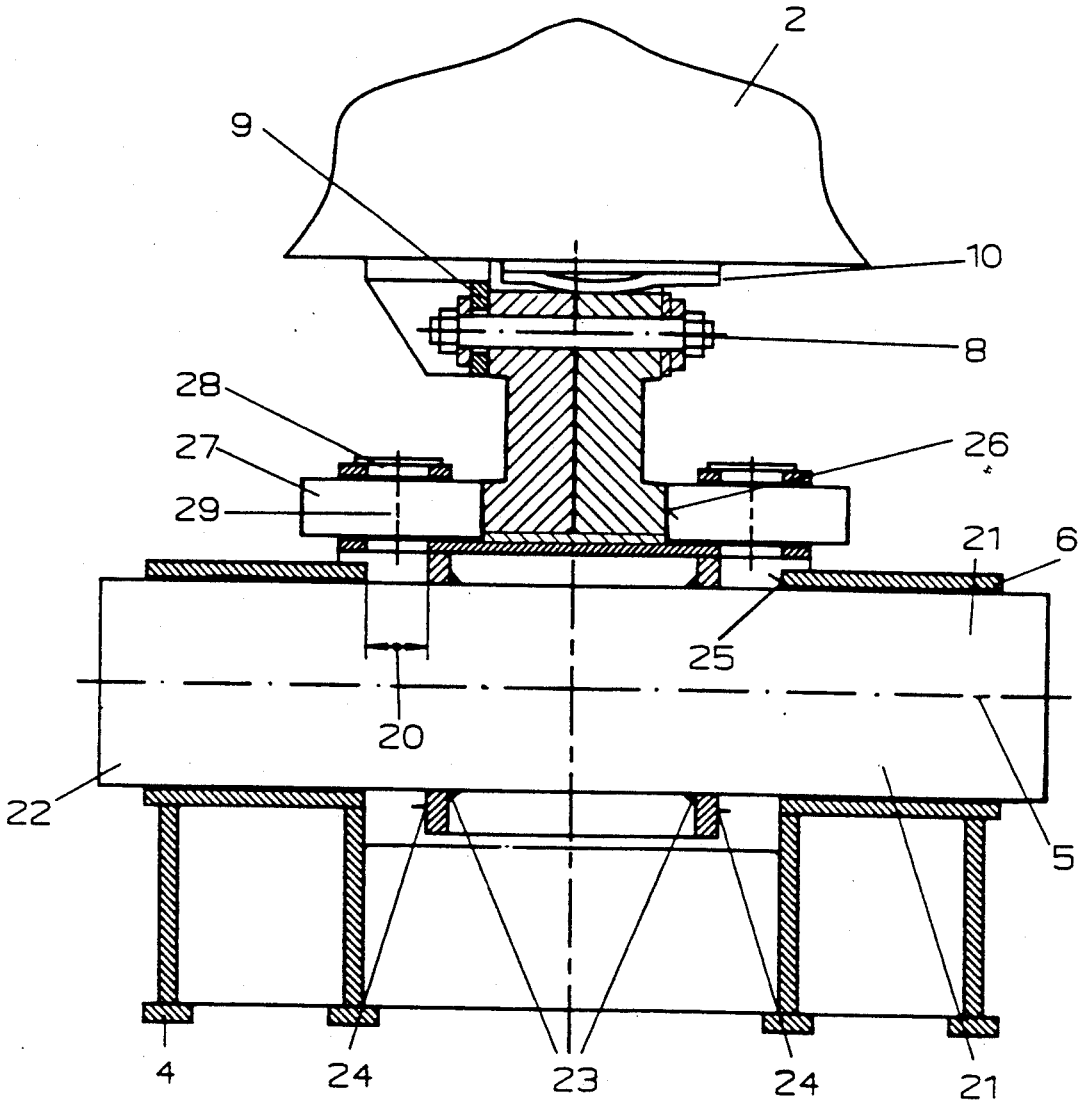
FIG. 3 is a sectional view taken along line B—B in FIG. 1.

The race 1 is comprised of transversely and longitudinally divided ring segments of bent and hardened or tempered rolled steel. Two sets of ring segments are assembled together with abutting sides to form longitudinal joints at the circumference of the race 1, with the ends of the segments of each set being offset with respect to another. The ring segments are attached to one another by close fitting bolts 8 extending through longitudinal holes in the ring segments, the bolts also extending with play through a lateral flange 9 of the rotary drum 2, as seen in FIG. 3. The race 1 is flexibly supported in its bore by a corrugated spring leaf 10 on the rotary drum, so that, when loaded, it can move to some extent with respect to the flat adjacent surface of the flange 9 in a radial direction.

A separate cradle 11 pivots in a respective rocker bearing 12 at each end of each intermediate cradle 7. Each rocker bearing 12 has a pivot point 13 and has only the sliding surface clearance required for its function, i.e., it does not actually have any bearing clearance.

Each of the identical cradles 11 of the intermediate cradle 7 has two ends spaced apart in the circumferential direction of the race 1. Each of these ends holds a load-carrying roller 14 in a freely rotatable double-row roller bearing (not shown), e.g., a tapered roller bearing. These roller bearings have rotational axes 15 which extend parallel to the rotational axis of the rotary drum 2. The load-carrying rollers 14 are held by the roller bearings at the respective ends of the cradle 11 to rotate around the rotational axes 15, so that they can rotate without slanting and without axial play.

The self-aligning bearing 12 of each cradle 11 is located in the center of the respective cradle between the two load-carrying rollers 14. The respective cradle 11 can pivot about the longitudinal pivot point 13 of the self-aligning bearing 12 and can assume a somewhat slanted position and, accordingly, can be adjusted automatically along the circumference of the race 1. In the process, the load-carrying rollers 14 roll with their substantially cylindrical outer surfaces 16 on a cylindrical or—in longitudinal section—slightly convex surface area 17 of the race 1.

The rotational axes 15 of the two adjacent load-carrying rollers 14 running in each cradle 11 along the circumference of the race 1, and the axis 5 of the journal bearing 6 are arranged side by side in a common axially extending plane 18.

In addition, the pivot points 13 of the self-aligning bearings 12 of the respective cradle are also located in the respective common plane 18. Accordingly, each pivot point 13 is located in the vicinity of a connecting line 19 joining the contact points between the two load-carrying rollers 14 of the respective cradle 11 and the race.

Each of the two intermediate cradles 7 (only one of which is shown) of the bearing arrangement receives the load of four load-carrying rollers 14. The load-carrying journal bearing 6 of each intermediate cradle 7 has an axial clearance 20 (see FIG. 3) which is equal to or larger than the axial dislocation of the load-carrying rollers 14 when the rotary drum 2 is in operation.

In the structure under consideration, the journal bearing 6 is built into the load bearing structure 4 in the form of two plain bearing bushes arranged coaxially at a mutual distance from one another on a cylindrical journal bolt 21. An end 22 of the journal bolt 21 extends inside the cylindrical bore of each plain bearing bush. The journal bolt 21 is rigidly attached to the intermediate cradle 7, between the two plain bearing bushes, by welded seams 23.

The axial clearance 20 of the journal bearing 6 with respect to the intermediate cradle is bound by ends 24 of the intermediate cradle 7 which are adapted to move with respect to the directly opposite axial ends 25 of the respective bearing bush.

A rotating flat axially extending lateral end 26, which extends perpendicular to the rotational axis of the rotary drum 2, is provided at each side of the race 1, adjacent to its rolling surface 17.

Guiding elements are provided which are rigidly connected to the intermediate cradle 7 and which can travel with or without pre-tension on the lateral ends 26, are provided in order to center the load-carrying rollers 14 with respect to the surface 17 of the race 1.

In the illustrated embodiment of the invention, the guiding elements are comprised of guiding rollers 27 which roll with their outside faces—which are slightly convex in longitudinal section—on the respective lateral surfaces 26.

A separate guiding roller 27 rolls on each of the two opposing, outwardly directed lateral surfaces 26 of the race 1. Each of the guiding rollers 27 is mounted by a sliding or rolling bearing (not shown) on a separate fixed bolt 28 of the intermediate cradle 7, so that the rollers 27 run freely in bearings on the respective bolt 28 around a rotational axis 29.

The rotational axes 29 of the two guiding rollers 27 are perpendicular to the rotational axis of the rotary drum 2 and perpendicular to the axis 5 of the respective intermediate cradle 7.

The construction of the embodiment described above can be changed without departing from the scope of the invention. Accordingly, in the extreme case, the pivot point of the self-aligning bearings may also be located on the line connecting the contact points between the two load-carrying rollers of a cradle and the race. For this purpose, the self-aligning bearing must be built accordingly. For example, the self-aligning bearing can be comprised of two self-aligning bearing disks located on both sides of the race with the effective pivot point located in the race, or by a self-aligning bearing slotted in the direction of the race, whereby the race extends radially in the slot of the self-aligning bearing from the outside toward the inside.

Sliding blocks, instead of the illustrated guiding rollers, may be attached to each intermediate cradle, the blocks sliding on at least one of the two lateral ends of the race, in order to hold the intermediate cradle with its cradle and load-carrying rollers in an orderly position over the surface area of the race.

The guiding elements do not have to be attached to the intermediate cradle. Indeed, they can be formed directly as part of the load-carrying rollers, in such manner that a projecting flange crown is formed on one—or on both sides—of the outside face, and runs on a directly opposite lateral face of the race.

It is also possible, however, to omit the guiding elements—guiding rollers, sliding blocks or the flange crown of the load-carrying rollers—when the radial roller contact forces between the load-carrying rollers and races are sufficient to direct the cradle with its load-carrying rollers, not only in the circumferential direction of the supporting ring but also to place it in an axial direction in the center of the surface area of the race.

Furthermore, an additional intermediate cradle may be attached on one or both ends of each of the illustrated intermediate cradles, the additional cradles being mounted to be free of slanting and without axial clearance at the respective end of the intermediate cradle and pivoting with axial clearance inside the load bearing structure.

In order to manufacture a bearing arrangement with axial attachment of the rotary drum, the guiding rollers of the intermediate cradle may be directly supported by load-carrying rollers or the like, which are rigidly attached to the load bearing structure so that contact forces of the guiding rollers operating in the direction of the rotational axis of the rotary drum do not in the least affect the accompanying intermediate cradle.

While the invention has been disclosed and described with reference to a single embodiment, it will be apparent that variations and modification may be made therein, and it is therefore intended in the following claims to cover each such variation and modification as falls within the true spirit and scope of the invention.

What is claimed is:

1. In a bearing arrangement for supporting an axially extending rotary drum, wherein both ends of a first load carrying roller rolling on a bearing surface of a race of the rotary drum are supported in a cradle, and wherein the cradle is supported in a pivot bearing by an intermediate cradle that is in turn supported by at least one load bearing structure to rotate around the axis of a journal bearing, the improvement comprising:

a second load carrying roller rolling on said surface of said race and circumferentially spaced from said first roller, both ends of said second roller being supported in said cradle means for supporting said load-carrying rollers on their rotational axes to be free of slanting and without axial clearance around the respective end of the cradle, said pivot bearing comprising means for supporting said cradle without bearing clearance in a self-aligning bearing with a pivot point located between the two load carrying rollers at the end of the intermediate cradle, and means for supporting the intermediate cradle in the journal bearing with an axial clearance of the same size or larger than the clearance of the axial bearing arrangement of the load-carrying rollers in the load bearing structure which occurs during the operation of the rotary drum.

2. The bearing arrangement of claim 1 wherein:

the pivot point of the self-aligning bearing is located on or in the vicinity of a line connecting the contact points of the two load carrying rollers of the respective cradle with the race.

3. The bearing arrangement of claim 1 wherein:

the rotational axes of two adjacent load-carrying rollers of a cradle at the circumference of the race and the axis of the journal bearing of the respective intermediate cradle are located side-by-side in a common longitudinal plane.

4. The bearing arrangement of claim 3 wherein:

the pivot point of the self-aligning bearing is located in the common axial longitudinal plane of the rotational axes of the two load carrying rollers of a cradle.

5. The bearing arrangement of claim 1 wherein the race has, on at least one of its two sides, a rotating lateral face for the axial movement of guiding elements, and wherein:

the guiding elements are rigidly affixed to the intermediate cradle for centering the load-carrying rollers with respect to the bearing surface of the race.

6. The bearing arrangement of claim 5 wherein:

the guiding elements are comprised of guiding rollers mounted on and freely rotatable in the respective intermediate cradle, and roll on one or both of the lateral faces of the race.

7. The bearing arrangement of claim 6 wherein:

the lateral faces are adjacent said bearing surface and extend axially outward therefrom, and wherein a separate single guiding roller is mounted to said intermediate cradle for engaging each of said lateral faces.

8. The bearing arrangement of claim 7 wherein:

the rotational axis of the two guiding rollers are perpendicular to the rotational axis of the rotary drum as well as to the pivotal axis of the respective intermediate cradle.

9. The bearing arrangement of claim 1 wherein:

the journal bearing of said intermediate cradle is comprised of two co-axial axially spaced cylindrical plain bearing bushes on the load bearing structure, and a cylindrical journal bolt mounted in between and extending through said bushes and attached solidly to the intermediate cradle.

10. The bearing arrangement of claim 9 wherein:

the axial clearance of the journal bearing of the intermediate cradle is bounded by faces which are solidly attached to the intermediate cradle, and which operate in conjunction with directly opposite axial faces of the respective plain bearing bush.

* * * * *